United States Patent [19]

Lohrmann et al.

[11] Patent Number: 4,613,124

[45] Date of Patent: Sep. 23, 1986

[54] SINGLE SHEET FEEDING

[75] Inventors: Gerhard Lohrmann, Elchingen; Kurt Roehrer, Niederstotzingen, both of Fed. Rep. of Germany

[73] Assignee: Mannesmann AG, Duesseldorf, Fed. Rep. of Germany

[21] Appl. No.: 561,360

[22] Filed: Dec. 14, 1983

[30] Foreign Application Priority Data

Dec. 17, 1982 [DE] Fed. Rep. of Germany ..... 3247341

[51] Int. Cl.[4] ..... B65H 3/42

[52] U.S. Cl. ..... 271/16; 271/170; 271/171; 271/127

[58] Field of Search ..... 271/16, 17, 21, 22, 271/24, 25, 169, 170, 171, 127

[56] References Cited

U.S. PATENT DOCUMENTS

| | | | |
|---|---|---|---|
| 3,857,558 | 12/1974 | Patel | 271/22 |
| 3,883,133 | 5/1975 | Rebres | 271/160 |
| 4,023,792 | 5/1977 | Punnett et al. | 271/22 |
| 4,221,374 | 9/1980 | Koch et al. | 271/21 |
| 4,359,215 | 11/1982 | Ruenzi | 271/22 |
| 4,438,915 | 3/1984 | Akamatsu et al. | 271/22 |
| 4,492,371 | 1/1985 | Kan et al. | 271/170 |

*Primary Examiner*—Bruce H. Stoner, Jr.
*Assistant Examiner*—John A. Caroll
*Attorney, Agent, or Firm*—Ralf H. Siegemund

[57] ABSTRACT

Single sheet feeding from a stack is provided by placing the stack onto flat bars defining a stack bottom and being part of a pivotable frame. That frame includes holddown fingers engaging the top sheet at its front edges, and, two separating rollers are provided laterally offset and at a higher level; the rollers are reversibly driven to pull the top sheet out from under the fingers, and upon reversing the rollers slide that sheet towards a platen drum being selectively drivingly coupled to the separating rollers.

6 Claims, 2 Drawing Figures

(A-B)

SINGLE SHEET FEEDING

BACKGROUND OF THE INVENTION

The present invention relates to single sheet feeding from a stack of sheets into a printer whereby particularly a feed channel is associated with a printing platen, and the feeding is carried out under utilization of driven transport rollers, a stack bottom being movable with respect to these rollers and including further stops for the stack as well as single sheet separating fingers.

Equipment for single sheet feeding including features for separating the individual sheets from a stack are, for example, used in a variety of printers and here, particularly, printers of the matrix variety. German printed Pat. No. 29 28 353 discloses, for example, to arrange transport rollers such that they establish a clamping gap for the sheet to be moved whereby the transport rollers are drivingly connected to the platen under utilization of a slip clutch. The finger singling out individual sheets is associated with that gap and there are operating elements for this finger which include a cam disk being slip free connected to the platen drum. These actuating elements include further a scanning lever cooperating with the aforementioned cam disk and acting upon the sheet singling finger accordingly. The transport rolls are spaced in relation to the transport equipment generally and in relation to the platen drum such that the advanced sheet is in engagement simultaneously with a sheet separating transport roller as well as with those transport rollers which establish the clamping gap, or with the platen drum.

The known equipment as described uses furthermore a movable bottom or platform for the stack of sheets which is spring biased and therefore urges the sheets against the separating rollers. This kind of arrangement does not exclude the possibility that the stack bottom urges more than one sheet by operation of the spring force so that the singling or separating roll in fact advances two sheets which are now shifted together against the sheet separating finger. Moreover, this known equipment provides this finger merely as a stop and the finger is not actually used for separating individual sheets in the range of the stack bottom.

DESCRIPTION OF THE INVENTION

It is an object of the present invention to provide a new and improved single sheet feeding arrangement for printers;

It is a particular object of the present invention to overcome single sheet feeding problems encountered by the necessity of having holddown means provided for the stack of sheets from which a single sheet is to be fed into a printer;

It is therefore a specific object of the present invention to provide a new and improved single sheet feeding arrangement which is particularly oriented towards solving the problems encountered by the necessity of holding a stack with a holddown, but requiring on the other hand that the topmost sheet be separated from that stack.

In accordance with the preferred embodiment of the present invention it is suggested to provide the stack bottom for a stack of sheets in form of one or more, preferably two, symmetrical arranged flat bars to be associated with lateral stops for retaining the stack as a whole but cooperating with holddown fingers near corners of the sheets of the stack. The bottom defining bars are associated with reversibly driven sheet separating rollers being provided at a somewhat higher level than the holddown fingers.

Sheet separation is carried out in that the separating rollers are first driven in one direction to pull the topmost sheet of a stack out from under the finger stops; subsequently these rollers reverse and slide that sheet over the finger stops and towards a platen drum cooperating, for example, with friction rollers and a suitable guide channel; the separating rollers are stopped when the platen drum with friction rollers has gripped the just separated sheet.

The inventive arrangement offers a plurality of advantages. The construction of the stacked bottom from plural bars with juxtaposed separating rollers permits the sheets, particularly the top sheet to bulge transversely to the direction of movement and advance. The holddown fingers on one hand and the level of arrangement of the separating rollers enhance this slight bulge which, so to speak, is straightened out as soon as the top sheet is moved out from under the holddown fingers whereupon the sheet can simply be reversed and will pass over the holddown fingers.

In furtherance of the invention it is suggested to provide the bottom defining bars with a slight bulge or curvature or angular offset so that the stack as a whole assumes a slight bulge in longitudinal direction. If a rear stop is provided then the notion by the separating rollers when pulling a sheet out from under the finger stops will in fact increase that longitudinal bulge which is of additional advantage for making sure that this pulled out sheet will thereafter remain out of the range of the holddown fingers and will, upon reversing of the separating rollers, pass clearly over them.

The bottom defining flat bars may be part of a rocker like frame which provides stack motion in an up direction on account of pivoting. A control may be provided which is spring biased and insures that the rocker is always tending to move i.e. to pivot in a direction so that the topmost sheet remains positively in engagement with the sheet separating rollers. This pivot motion makes sure that the force by means of which the uppermost sheet is urged against the separating rollers is always constant irrespective of the height of the stack. A slidable partition on the frame may be provided in order to define definite lateral boundaries for the sheet stack.

The sheet separating rollers are preferably mounted on a shaft which is drivingly connected to the platen drum under interpositioning of a clutch such that the separating rollers can be made to follow the platen drum motion or be drivingly separated therefrom.

DESCRIPTION OF THE DRAWINGS

While the specification concludes with claims, particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
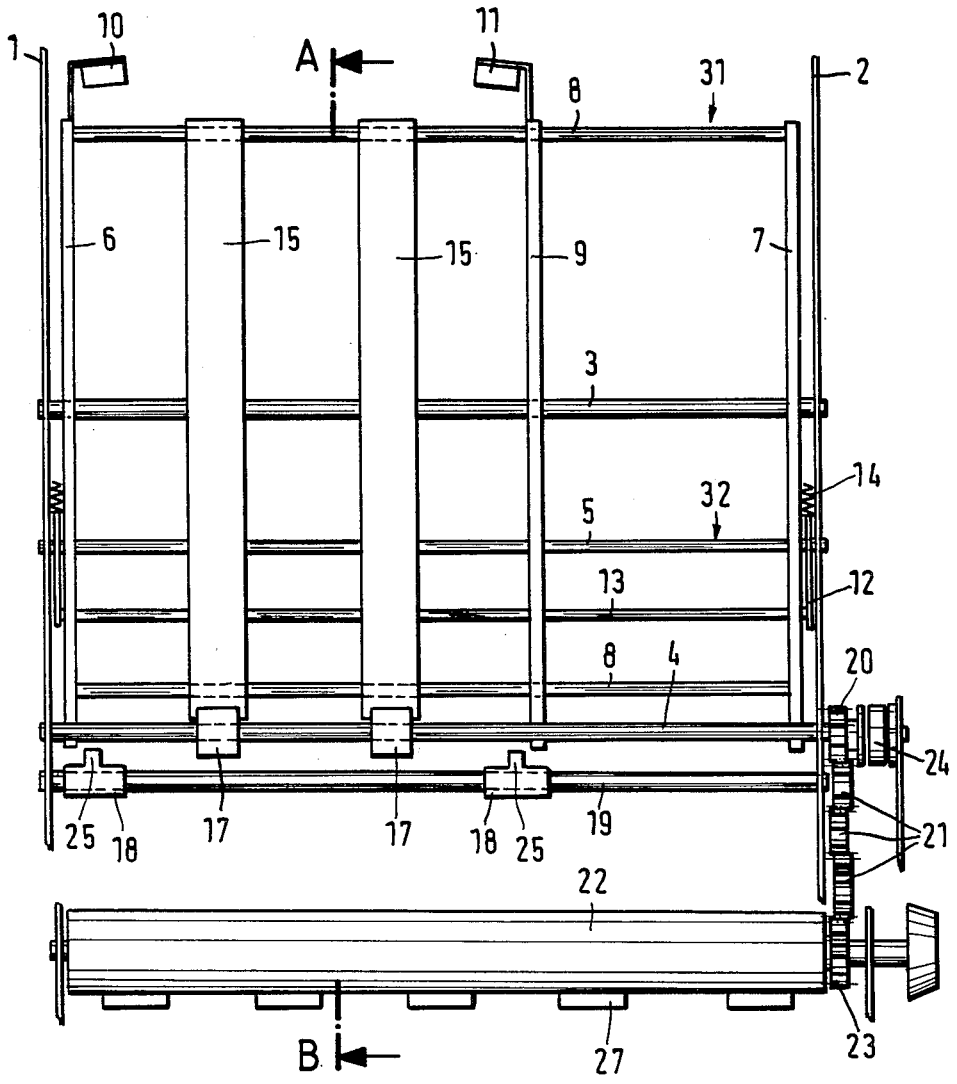
FIG. 1 is a top view of an arrangement constructed in accordance with the preferred embodiment of the present invention for practising the best mode thereof.

Proceeding now to the detailed description of the drawings, the Figures illustrate generally a frame of the type used for matrix printers and including particularly side pieces or members 1 and 2. Shafts 3, 4 and 5 are journaled in these sides through suitable bearings. These shafts are provided for the following functions.

A rocker 31 is pivotally mounted on the shaft 3. The rocker includes guide sides 6 and 7 separated from each other by spacer rods 8 which may be secured to these sides or just loosely positioned. A further guide wall 9 or partitioning rides on these spacer rods 8 and can be laterally shifted in order to adjust the system to a desired sheet and stack width. The partition 9 may be clamped to the shaft 3 after the desired width has been adjusted and obtained. Locking equipment including locking levers of this type are generally well-known and are not illustrated. Such a device is really required only if the wall or partition 9 rides very loosely on these various elements in order to permit easy adjustment; otherwise friction could suffice.

Stop pieces or members 10 and 11 are affixed to the rear ends of the wall 6 and the partition 9 respectively. These stops may be longitudinally adjustable whereby the adjustment is conceivably carried out in individual steps or on a continuous basis. The adjustment here, of course, is necessary to adjust the system and device to different sheet lengths.

The shaft 4 carries rollers 17 which are provided for separating and singling individual sheets. Moreover, the shaft 4 extends beyond the frame wall 2 and carries a portion of a gear and drive train to be described more fully below.

The shaft 5 is actually a portion of a control bridge 32 which includes additionally two outer levers 12 being secured to the shaft 5, the bridge is essentially completed by a shaft 13. The sidewall 6 of the rocking structure 31 is provided with an oblong slot **6*a*, there being corresponding oblong slots in partition 9 and the sidewall 7. The shaft 13** traverses these slots.

Figure 2:
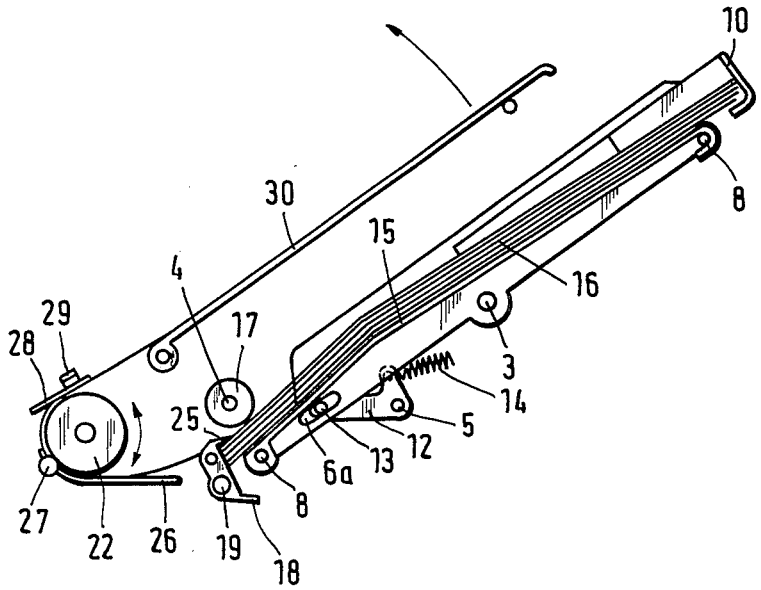
FIG. 2 illustrates a section view taken in the plane A—B in FIG. 1.

The control bridge 32 is under bias by two tension springs 14 for tending to pivot the bridge 32 in clockwise direction as per the view of FIG. 2. Whatever movement is carried out by the control bridge 32 is imparted upon the shaft 13 which in turn carries along the rocker structure 31. A stack of sheets or form papers 16 or the like sits on flat bar elements 15. These bars establish the feed bottom. They are symmetrically arranged with respect to the partitions 6 and 9. Bars 15 are slightly bent, so that stack sheets are bent accordingly. The spring force urges this stack 16 against the singling and sheet separating rollers 17 which are mounted on the shaft 4. The force exerted thereby remains constant and is independent from the height of the stack 16. Two front stops 18 mounted on a shaft 19 limit the stack 16.

The device is driven by means of a motor which is not shown. However, the immediate drive force and rotation is imparted upon the device by driving the shaft 4 through a coupling or clutch wheel gear 20. A drive train of gears 21 couples the gear 20 to a gear 23 which is drivingly connected with the printing platen drum 22. Therefore, any motion which the printing platen 22 undergoes is imparted upon the shaft 4. However, the gear 20 is a member of an electromagnetic clutch 24 which requires energization in order to complete this drive train.

The device as described thus far operates as follows. It is assumed that a stack of sheets 16 sits on these flat support bars 15 and single sheet feeding is to take place. The electromagnetic coupling 24 is energized and the printing platen or platen drum 23 will rotate in accordance with a preprogrammed path in a counterclockwise direction as far as the view in FIG. 2 is concerned. The shaft 4 is drivingly connected to the platen drum 23 because the clutch or coupling 24 is energized so that indeed the shaft 4 will likewise be rotated. Therefore, the separating rollers 17 sitting on shaft 4 are likewise driven.

The uppermost sheet of the stack 16 is urged by means of the spring and through rocking motion about the shaft 13 against the separating rollers 17. Due to the particular rotation these rollers undergo that top sheet, in a first phase, is shifted back until abutting stops 10 and 11. This first phase is immediately followed by a second phase in which this upper sheet abuts against the stops 10 and 11 but the rollers 17 continue their motion, and therefore, move the edge portion of the sheet out of the range of the fingers 25 which normally hold the stack down while additionally the slight curvature of the stack on account of the slight curvature of the bars 15, is increased, i.e. the slightly curved top sheet bulges upwardly. Moreover, as the upper sheet is pushed out from under the fingers 25, the previously held down lateral edges of the sheet can bend back because they were transversely curved due to the elevational difference between the fingers 25 and the roller 17.

Now in a third phase, the motion of the platen roller 22 and therefore of the shaft 4 is reversed; accordingly, the separating rollers 17 reverse direction and move this top sheet away from the stops 10 and toward the platen drum 22. The sheet therefore having its edges bent back are now readily moved over the fingers 25 and further motion is guided by the sheet 26 until friction rollers 27 clamp the sheet between the platen roller 22 and rollers 27. Thereupon clutch 24 is deenergized and the rollers 17 stop. No further motion is needed because further movement of the singled out sheet is carried out through the rollers 22 and 27.

There is another guide sheet 28 provided to run the sheet into a proper direction and away from the platen roller 22. The sheet 28 carries a sensing device 27 which scans, for example, the front edge of an arriving single sheet. This arrival signals to the printer as a whole a particular position of the sheet vis-a-vis the printing platen 22 and now a programmed motion can take over to position the sheet properly with respect to the printing equipment proper which is not shown. After printing has been completed, the sheet will be moved by means of the elements 27 and 22, onto a shelf-like element 30 which is of the fold away type. Folding away is desirable so that it is easy to place a stack of sheets or forms in the proper orientation onto the rocker 31.

It can readily be seen that the single sheet feeding is applicable to multiple stack operations. Also one may provide a second stack or a different stacks for forms and envelopes to be called upon through proper programming of the equipment as a whole.

The invention is not limited to the embodiments described above but all changes and modifications thereof not constituting departures from the spirit and scope of the invention are intended to be included.

We claim:

1. Apparatus for single sheet feeding in a printer comprising:

two flat bar elements movably arranged and provided for holding a stack of sheets, the motion permitting raising and, lowering the stack of sheets, there being a topmost sheet accordingly;

two sheet-separating rollers disposed respectively adjacent said flat bar elements;

a rocking frame being comprised of side sheets and spacer rods and including said flat, stack-bottom defining bar elements, there being a shaft on which said rocking frame is pivotably journaled;

means for reversibly driving said rollers in unison;

two holddown fingers arranged respectively laterally displaced from the separating rollers and from the bar elements near two corners of the stack, for particularly holding down said stack including said topmost sheet, the separating rollers being provided at a somewhat higher level than said holddown fingers, said fingers being laterally displaced from said separating rollers so that the latter still engage the top sheet even though the fingers hold the stack including the top sheet down further;

the reversibly driven separating rollers pulling the topmost sheet first out from under said fingers and upon reversing direction the rollers slide the sheet over said fingers; and a printing platen drum with associated transport rolls and guide elements disposed for engaging a sheet that has been moved by said separating rollers over said holddown fingers.

2. Apparatus as in claim 1 said bars being slightly bent so that the sheets of the stack obtain a slightly bulging contour.

3. Apparatus as in claim 1 there being a control bridge including side elements and interconnecting means for operating said rocking frame there being springs for biasing said control bridge.

4. Apparatus as in claim 1 said rocking frame including an additional partition for being adjusted to a particular width of said stack.

5. Apparatus as in claim 1 said separating rollers being drivably connected to said platen drum, there being an electromagnetically operating clutch interposed.

6. Apparatus as in claim 2 there being a rear abutment stop against which the sheet is pushed by operation of the separating rollers when pulling said top sheet out from under the finger stops.

* * * * *